US005418105A

United States Patent [19]

Wayman et al.

[11] Patent Number: 5,418,105

[45] Date of Patent: May 23, 1995

[54] SIMULTANEOUS TRANSFER AND FUSING OF TONER IMAGES

[75] Inventors: William H. Wayman, Ontario; Dan A. Hays, Fairport, both of N.Y.

[73] Assignee: Xerox Corporation, Stamford, Conn.

[21] Appl. No.: 168,891

[22] Filed: Dec. 16, 1993

[51] Int. Cl.[6] ..... G03G 13/14

[52] U.S. Cl. ..... 430/126; 355/271; 430/124

[58] Field of Search ..... 430/124, 126; 355/271

[56] References Cited

U.S. PATENT DOCUMENTS

| | | | |
|---|---|---|---|
| 3,564,556 | 2/1971 | Tsukatani et al. | 346/74 |
| 3,611,419 | 10/1971 | Blumenthal | 346/74 ES |
| 3,672,887 | 6/1972 | Matsumoto et al. | 96/1.2 |
| 3,687,661 | 8/1972 | Sato et al. | 96/12 |
| 3,893,761 | 7/1975 | Buchan et al. | 355/3 R |
| 3,923,392 | 12/1975 | Buchan et al. | 355/3 R |
| 3,947,113 | 3/1976 | Buchan et al. | 355/3 R |
| 4,155,093 | 5/1979 | Fotland et al. | 346/159 |
| 4,160,257 | 7/1979 | Carrish | 346/159 |
| 4,240,084 | 12/1980 | Tacklind et al. | 346/153 |
| 4,267,556 | 5/1981 | Fotland et al. | 346/153.1 |
| 4,286,031 | 8/1981 | Kuehnle et al. | 430/44 |
| 4,353,970 | 10/1982 | Dryczynski et al. | 430/31 |
| 4,365,549 | 12/1982 | Fotland et al. | 101/1 |
| 4,395,472 | 7/1983 | Robillard | 430/47 |
| 4,403,848 | 9/1983 | Snelling | 355/4 |
| 4,408,214 | 10/1983 | Fotland et al. | 346/159 |
| 4,569,584 | 12/1986 | St. John et al. | 355/14 R |
| 5,103,263 | 4/1992 | Moore et al. | 355/212 |
| 5,212,526 | 5/1993 | Domoto et al. | 430/124 |

*Primary Examiner*—John Goodrow

[57] ABSTRACT

Three fuser rollers cooperate with a pressure roller to form an extended fusing zone through which a substrate carrying toner images passes with the toner images contacting the fusing belt. Electrical power is applied to the three fuser rolls in such a manner that only the portions of the belt in the fusing zone are heated. The energy is concentrated only in the part of the fusing belt where it is needed for fusing the toner images on the final substrate. Thus, the free extent of the belt or in other words the portion of the belt outside of the fusing zone remains unheated. Toner images are directly formed on or transferred to the unheated portion of the fusing belt. The images carried by the belt are then moved through the fusing zone where the images are simultaneously transferred and fused to a final substrate.

14 Claims, 2 Drawing Sheets

SIMULTANEOUS TRANSFER AND FUSING OF TONER IMAGES

BACKGROUND OF THE INVENTION

This invention relates to the art of forming powder images and, more particularly, to heat and pressure belt fuser apparatus wherein images are formed directly on the fuser belt or transferred thereto for subsequent transfusing thereof to a final substrate.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric image by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus.

The toned image layer may alternately be formed by an ionographic imaging process. In an ionographic imaging process, a latent image is formed on a dielectric image receptor or electroreceptor by ion deposition, as described, for example, in U.S. Pat. Nos. 3,564,556, 3,611,419, 4,240,084, 4,569,584, 4,408,214, 4,365,549, 4,267,556, 4,160,257, and 4,155,093. Generally, the ionographic process entails the use of an ionographic writing head for application of charge in an imagewise pattern on a dielectric receiver t hat retains the charged image. The image is subsequently developed with a developer capable of developing charge images. The toned image layer may then undergo further processing and, finally, be simultaneously transferred and fused to a recording medium, such as paper.

Regardless of the imaging process used, it may be used to develop black, single color, or multi-color images. Multi-color imaging may be done either as a fully formed image or a step formed image. A fully formed image implies that an image with multiple colors is fully formed on the image receptor and then transferred to the recording medium in a single step. In a step formed image the colored toner images are individually formed on the image recorder and transferred to the recording medium one color at a time. Processes for forming monochromatic or polychromatic electrostatic images are disclosed, for example, in U.S. Pat. Nos. 3,672,887, 3,687,661, 4,395,472, 4,353,970, 4,403,848, and 4,286,031. Also, color images may be formed as images on images or images next to images.

U.S. patent application Ser. No. D/93506 (Attorney's Docket No.) which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

To ensure good electrical contact in the presence of silicone oil contamination on the inner surface of the fusing belt, the contact rollers are textured by knurling bead blasting or any other suitable means. The use of textured rollers improves the electrical contact between the rollers and the resistive layer of the belt. Also, it circumvents the adverse affects that the silicone has on smooth surfaced rolls.

U.S. patent application Ser. No. D/93507 (Attorney's Docket No.) which is assigned to the same assignee as the instant invention relates to belt fuser wherein three fuser rollers cooperate with a pressure roller to form an extended fusing zone through which a belt with resistive substrate or resistive inner coating carrying toner images passes with the toner images contacting the fusing belt. Electrical power is applied to the three fuser rolls in such a manner that only the portions of the belt in the fusing zones are heated to a predetermined operating temperature. The free extent of the belt or in other words the portion of the belt outside of the fusing zone is adapted to be heated to various operating temperatures in order to produce prints with different gloss levels.

U.S. patent application Ser. No. D/93508 (Attorney's Docket No.) which is assigned to the same assignee as the instant invention relates to a power controller which does not rely on the use of sensors such as thermistors to control the operating temperature of a belt fuser. It features various preset inputs to control steady state watts/in, cold start boost watts/in, warmup and cooldown time constants.

The controller sets the desired power based on the on-off cycling of the system. There are no sensors used to measure fuser temperature. For a cold start, the steady state plus boost power is used, during warmup the boost level is exponentially decreased at a rate set by a warmup time constant. When at rest (with no applied power) the power setpoint is exponentially increased at a rate set by a cooldown time constant.

U.S. patent application Ser. No. D/92622 (Attorney's Docket No.) which is assigned to the same assignee as the instant invention relates to a belt fuser for fusing transparencies without having to resort to off-line methods and apparatus. The toner images which are formed on the transparency during the imaging process have time to cool prior to separation from a smooth-surfaced belt.

U.S. patent application Ser. No. D/92623 (Attorney's Docket No.) which is assigned to the same assignee as the instant invention relates to a belt fuser wherein tree fuser rollers cooperate with a pressure roller to form an extended ruling zone through which a belt with resistive substrate or resistive inner coating carrying toner images passes with the toner images contacting fusing belt. Electrical power is applied to the three fuser rolls in such a manner that only the portions of the belt in the focusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

U.S. Pat. No. 5,212,526 granted to Domoto, et. al. on May 18, 1993 relates a method of transferring images from an image receptor to a recording medium, which method comprises forming a toned image layer on a surface of an image receptor, the toned image layer comprising a toner material and a radiation curable material; contacting a recording medium with the toned image layer; and irradiating the toned image layer in contact with the recording medium to cure said radiation curable material; wherein the resulting cured material has greater adhesion to the toner material and the recording medium than to the surface of the image receptor. The radiation is transmitted through the image receptor and onto the toned image layer to cure the radiation curable material.

U.S. Pat. No. 5,103,263 granted to Moore et al on Apr. 7, 1992 relates to a photoconductive or magnetic filler which allows a single thin belt to serve as the imaging element, i.e., as the latent and developed image carrier, as well as the element which transfers and fuses toner to a print. The transport member moves in a cyclic path to carry material from a first location to a second location maintained at a higher temperature, and counter-moving portions of the member are positioned to exchange heat with each other along an intermediate portion of the path, so that minimum energy is lost to the environment. In one embodiment as a printing apparatus, a be It transports a heat-fusible toner to a heated location where it is transferred and fused, i.e., as a print image to a sheet. Effective powder pick up and release is obtained in the printing apparatus with a transport member having an elastomeric layer of a softness which conforms to a receiving member of characteristic surface roughness, and a non-tacky outer coating which is harder than the elastomeric layer. The location at the lower temperature is maintained in a preset operating range by a cooler or ventilator. The higher temperature location is maintained at the higher temperature by a heater.

In the field of photocopying or printing, it is known to print by first forming an electrostatic latent image on a photoconductive drum or belt, developing the electrostatic latent image on the drum with a toner, and then transferring the toner to a moving belt which carries the toner past a heat fusing station where the toner is melted and transferred to paper or some other print substrate. Systems of this type are shown in U.S. Pat. Nos. 3,893,761; 3,923,392 and 3,947,113. Such a system has been made and marketed commercially. In the commercial system known to applicant, the belt transports developed toner images to a high temperature fusing and transfer station. The belt is relatively thick, e.g., one or more millimeters thick, that is operated isothermally at a temperature over 100° Celsius which is sufficient to fuse the transported toner. In such a construction, the belt serves to isolate the primary latent-image forming member, which is a photoconductive belt, from the high fusing temperatures allowing the photoconductive belt to operate with conventional powdered toner image development technologies.

Such a construction results in a complex assembly wherein a first image forming and toner transport mechanism is operated at one temperature, and a comparably large transport assembly is maintained at a higher temperature within the machine. The machine requires a significant power input for its healed portion, and is mechanically complex. The transfer of toner between two or more intermediate members adversely affects image quality, particularly if the intermediate members are heated.

Accordingly, it would be desirable in systems of this sort to simplify the mechanical structure, reduce the power requirements, and improve the image transfer characteristics.

It is an object of the invention to provide an efficient image forming apparatus wherein a toner image is formed at one location on an unheated segment of a combination fusing and image receptor belt and then at a second location where the belt is heated to simultaneously transfer and fuse the toner image from the combination belt to a substrate to form a print.

BRIEF SUMMARY OF THE INVENTION

These objects and other desirable qualities are achieved in the present invention by printing system wherein an endless belt is moved between an unheated location where toner images are formed thereon and a heated fusing zone location where the particles forming the toner images are simultaneously softened and transferred to a sheet to form a final print. The belt comprises a thin film polymeric, construction with an electrically resistive coating or resistive substrate providing joule heating.

Three fuser rollers cooperate with a pressure roller to form an extended fusing zone. Electrical power is applied to the three fuser rollers in such a manner that only the portions of the belt in the fusing zone are heated. The energy is concentrated only in the part of the belt where it is needed for fusing the toner images on the final substrate. Thus, the free extent of the belt or in other words the portion of the belt outside of the fusing zone is unheated via the electrical power supplied to the three fuser rolls. The unheated segment or free extent of the belt is utilized for forming toner images directly thereon in accordance with well known imaging techniques.

The toner images may be either transferred to the belt or formed directly on the belt. The images regardless of how they are formed on the belt are simultaneously transferred and fused to a substrate as it passes through the heated fusing zone area.

DETAILED DESCRIPTION OF THE DRAWINGS

DESCRIPTION OF THE PREFERRED EMBODIMENT OF THE INVENTION

Figure 1:
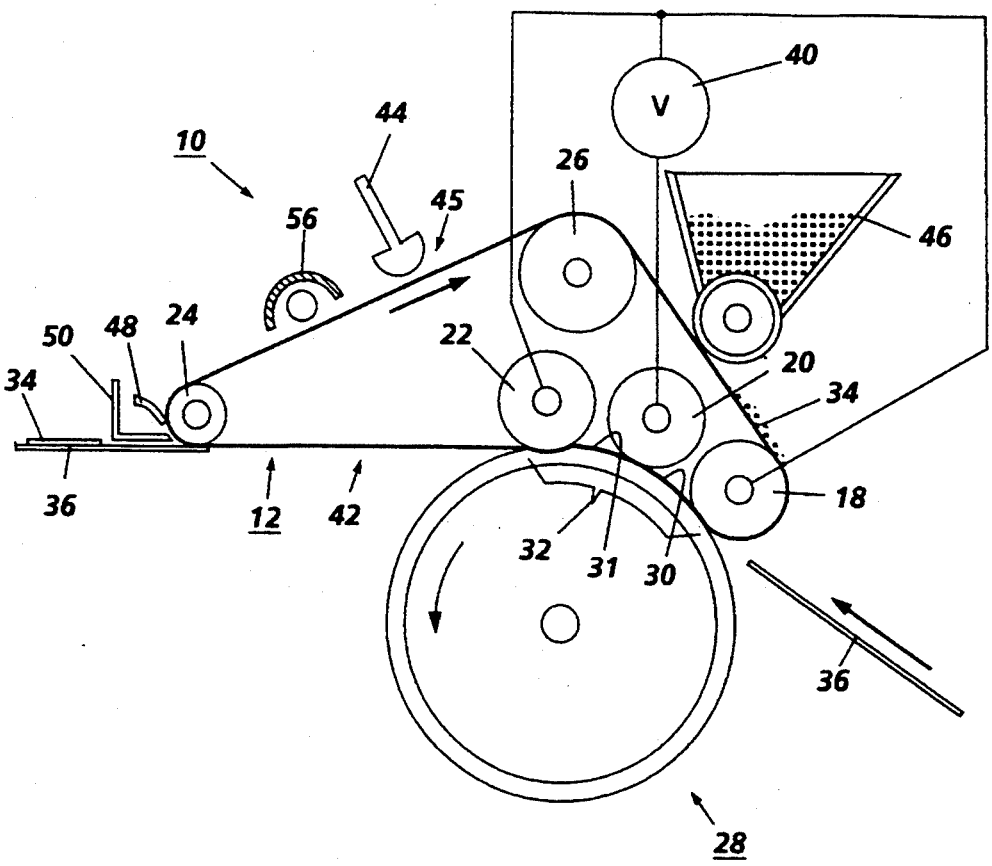
FIG. 1 is a schematic illustration of an imaging apparatus according to the invention.
Figure 4:
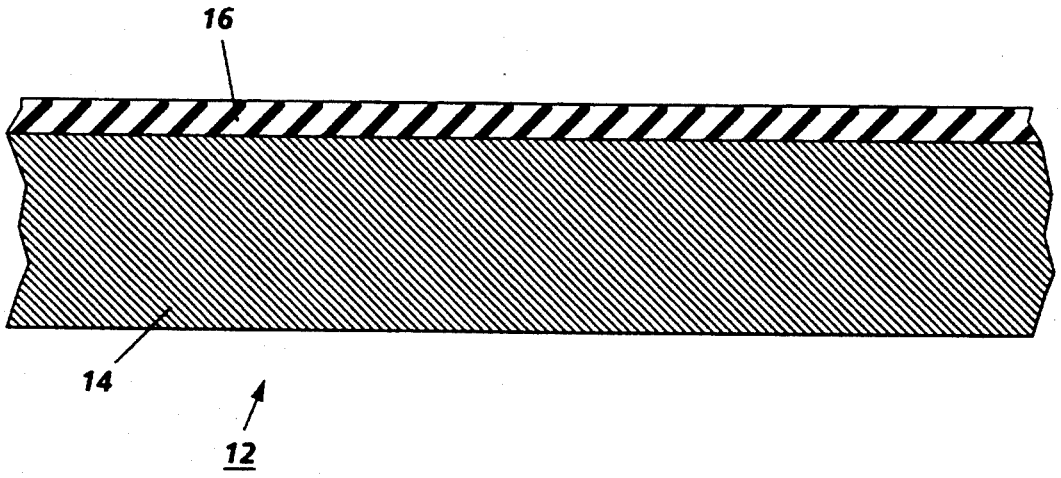
FIG. 4 is a schematic illustration of a belt structure incorporated in the present invention.

As disclosed in FIG. 1, a printing apparatus 10 according to the present invention comprises a seamless, image receptor belt structure 12. The belt structure 12 (FIGS. 1, 2 and 4) comprises a resistive Kapton (Trademark of E. I. du Pont de Nemours & Co.) XC Polyimide film substrate 14 (FIG. 4). The substrate film has a thickness in the order of 25–100 microns, with a resistivity of 150–1000 ohm/square. This resistive heating substrate is coated with 5–50 micron dielectric/release layer 16 (FIG. 4).

The dielectric/release layer is composed of silicone rubber or other material with high temperature stability, high resistivity for low charge decay and low surface energy for good toner release. The dielectric/-release layer is applied to the resistive Kapton XC Polyimide film substrate by spray coating or other suitable means.

The belt structure 12 is entrained about fuser rollers 18, 20 and 22 as well as a stripping roller 24 and an idler or steering roller 26. The rollers 18, 20 and 22 are electrically conductive contact rollers which are electrically biased for dying voltages across a portion or segment of the belt structure 12 which physically contacts these rollers. By contact is meant that these rollers contact the resistive substrate layer 14. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

A pressure roller 28 cooperates with the rollers 18, 20 and 22 with portions or segments 30 and 31 of the belt 12 disposed there between to form a fusing zone or transfuse station 32 through which the belt carrying toner images 34 thereof are passed for simultaneously transferring and fusing the toner images 34 to substrates 36. A total nip pressure of approximately 50 lbs. is exerted between the fuser roller 22 and the pressure roll 28 by conventional structure used for that purpose.

Figure 2:
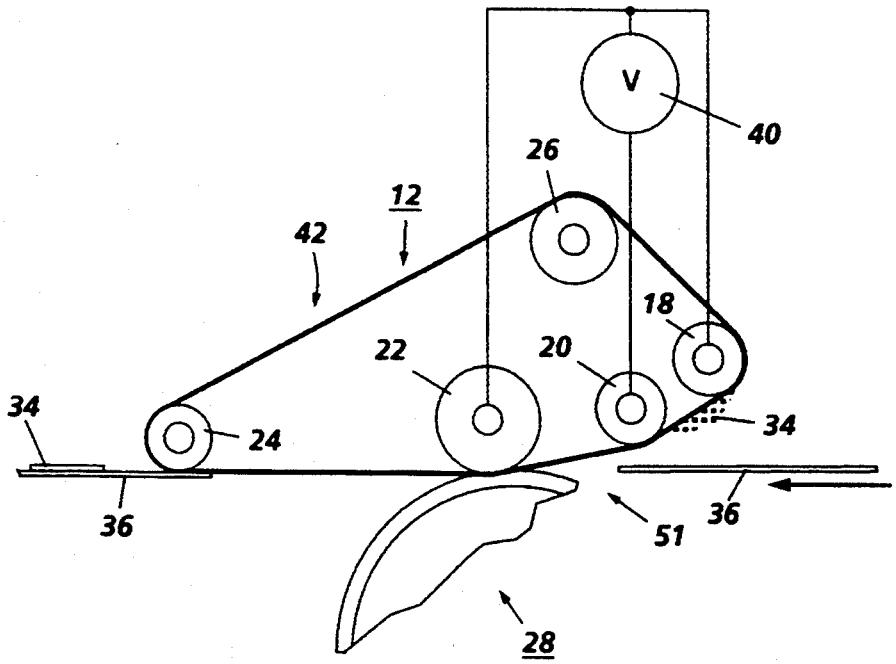
FIG. 2 is a schematic illustration of a modified embodiment of the invention illustrated in FIG. 1.

Alternatively, fusing rollers 18 and 20 need not necessarily form a nip with pressure roller 28, as shown in FIG. 2. As illustrated therein a fly-in zone 51 is provided by the positioning of the rollers 18 and 20 as shown in FIG. 2. As will be noted, many of the components from FIG. 1 have been omitted since the they are not needed to illustrate the fly-in feature designated by reference character 51.

Figure 3:
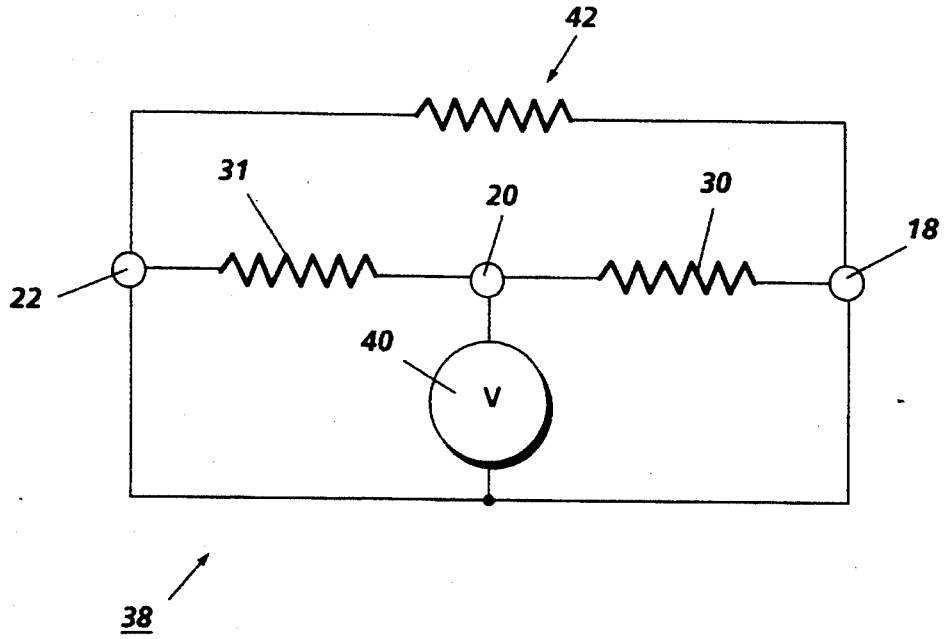
FIG. 3 is a schematic diagram of circuit for enabling the fuser apparatus of FIG. 1 to function in accordance with the present invention.

An electrical circuit 38 for applying power to the heating zones 30 and 31 as disclosed in FIGS. 1 and 3 comprises an AC power source 40 electrically connected to the three conductive fuser rollers 18, 20 and 22. The voltage is applied between roller 18 constituting a fusing zone entrance roller and the enter roller 20 and between the center roller 20 and roller 22 constituting a fusing zone exit roller. The entrance and exit rollers are connected together at equal potential. Thus, the fusing zone portion or segment 42 of the belt structure 12 which does not contact any of the rollers 18, 20 and 22 is not heated by the power source 40.

An imaging device herein disclosed as an ionographic print head 44 is provided for forming latent electrostatic images on the belt structure 12 at an imaging station 45 intermediate the idler roller 26 and the stripping roller 24.

A developer structure 46 is provided for rendering the latent electrostatic images visible. As will be appreciated, toner images may be formed on a separate belt or drum in accordance with conventional imaging methods and then transferred to the belt structure 12 with subsequent transfer and fusing to a final substrate as the final substrate is brought into registry with the toner images in the fusing zone 32.

Since the belt 12 is not heated by the voltage source when it is disposed between the exit roller 22 and the stripping roller 24, a relatively long extent of cooler belt structure is provided. Thus, the toner images have time to cool and become relatively non-tacky prior to their separation from the belt. Thus, efficient toner transfer to the final substrate is provided.

Although a preponderance of toner image is transferred to the final support material 36, invariably some residual toner remains on the imaging surface 12 after the transfer of the toner image to the final support material. The residual toner particles remaining on the imaging surface 12 after the transfer operation are removed from the belt 12 using a brush or cleaning blade 48 in contact with the outer periphery of the belt 12. The particles so removed are contained within a housing 50.

A corotron 56 is used to erase any remaining charge from previous image and level the belt surface potential in preparation for the next charging cycle etc.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A method of forming powder images, said method including the steps of:

moving belt structure through an endless path including an imaging station and a transfuse station;

applying an electrical bias to said belt structure such that it is unheated due to said bias when it passes through said imaging station and heated when it passes through said transfuse station;

forming toner images on said belt structure as it passes through said imaging station;

simultaneously transferring and fusing said toner images to a final substrate as they pass through said transfuse station; and allowing said images time to cool prior to separating them from said belt structure.

2. The method according to claim 1 wherein the step of applying an electrical bias comprises applying the bias to a plurality of conductive contact rollers supporting said belt structure for movement through said endless path and forming a fusing zone.

3. The method according to claim 2 wherein said step of moving a belt structure comprises using a belt structure including a resistive substrate and an outer dielectric/release layer.

4. The method according to claim 2 wherein said substrate has a thickness in the order of 30 to 150 microns and a resistivity in the order of 150 to 1000 ohm/-square.

5. The method according to claim 4 wherein said dielectric/release layer has a thickness of 5–50 microns.

6. The method according to claim 2 wherein said belt structure is supported for movement by said plurality of conductive contact rollers, an idle roller and a stripping roller.

7. The method according to claim 6 wherein said idler rollers and stripping roller are electrically isolated from or at equal potential with outer fusing zone forming rollers so that the belt structure is unheated when it passes through said imaging station and heated when it passes through said transfuse station.

8. Apparatus for forming powder images, said apparatus comprising means for moving belt structure through an endless path including an imaging station and a transfuse station;

means for applying an electrical bias to said belt structure such that it is unheated when it passes through said imaging station and heated when it passes through said transfuse station;

means for forming toner images on said belt structure as it passes through said imaging station;

means for simultaneously fusing and transferring said toner images as they pass through said transfuse station; and means for allowing said images time to cool prior to separating them from said belt structure.

9. Apparatus according to claim 8 wherein said means for applying an electrical bias comprises means for applying the bias to a plurality of conductive contact rollers supporting said belt structure for movement through an endless path and forming a fusing zone.

10. Apparatus according to claim 9 wherein said belt structure comprises a conductive substrate and an outer dielectric/release layer.

11. Apparatus according to claim 10 wherein said substrate has a thickness in the order of 30 to 150 microns and a resistivity in the order of 150 to 1000 ohm/-square.

12. Apparatus according to claim 11 wherein said dielectric/release layer has a thickness of approximately 5–50 microns.

13. Apparatus according to claim 9 wherein said belt structure is supported for movement by said plurality of conductive rollers, an idler roller and a stripping roller.

14. Apparatus according to claim 13 wherein said idler rollers and stripping roller are electrically isolated from or at equal potential with the outer fusing zone forming rollers so that belt structure is unheated when it passes through said imaging station and heated when it passes through said transfuse station.

* * * * *